US009664193B2

(12) United States Patent
Fledersbacher et al.

(10) Patent No.: US 9,664,193 B2
(45) Date of Patent: May 30, 2017

(54) TURBINE FOR AN EXHAUST GAS TURBOCHARGER

(71) Applicant: IHI CHARGING SYSTEMS INTERNATIONAL, Heidelberg (DE)

(72) Inventors: Peter Fledersbacher, Stuttgart (DE); Manfred Guthoerle, Neckarbischofsheim (DE); Torsten Hirth, Rutesheim (DE); Andreas Mueller, Dossenheim (DE); Timo Schulz, Heidelberg (DE); Carsten Van Lil, Heidelberg (DE)

(73) Assignee: IHI CHARGING SYSTEMS INTERNATIONAL GMBH, Heidelberg (DE)

( * ) Notice: Subject to any disclaimer, the term of this patent is extended or adjusted under 35 U.S.C. 154(b) by 494 days.

(21) Appl. No.: 14/298,836

(22) Filed: Jun. 6, 2014

(65) Prior Publication Data

US 2014/0294576 A1 Oct. 2, 2014

Related U.S. Application Data

(63) Continuation-in-part of application No. PCT/EP2012/003970, filed on Sep. 22, 2012.

(30) Foreign Application Priority Data

Dec. 8, 2011 (DE) ..... 10 2011 120 553

(51) Int. Cl.

| | |
|---|---|
| ***F01D 17/14*** | (2006.01) |
| ***F04D 17/08*** | (2006.01) |
| ***F01D 17/16*** | (2006.01) |

(52) U.S. Cl.
CPC ..... *F04D 17/08* (2013.01); *F01D 17/143* (2013.01); *F01D 17/16* (2013.01); *F05D 2220/40* (2013.01)

(58) Field of Classification Search
CPC ..... F04D 17/08; F01D 17/143; F01D 17/16; F05D 2220/40
See application file for complete search history.

(56) References Cited

U.S. PATENT DOCUMENTS 9,488,065 B2 * 11/2016 Olmstead ..... F01D 17/16
2006/0037317 A1 2/2006 Leavesly
(Continued)

FOREIGN PATENT DOCUMENTS

| | | |
|---|---|---|
| DE | 10 2009 006 278 | 7/2010 |
| EP | 1301 689 | 9/2006 |
| EP | 2 025 897 | 2/2009 |

*Primary Examiner* — Craig Kim
*Assistant Examiner* — Eldon Brockman
(74) *Attorney, Agent, or Firm* — Klaus J. Bach

(57) ABSTRACT

In a turbine for an exhaust gas turbocharger with a turbine casing having a receiving chamber for accommodating a turbine wheel and at least one volute through which the exhaust gas is guided via a feed passage into the receiving chamber and wherein at least one guide element is provided in the turbine casing so as to project into the feed passage in a guide region for guiding the exhaust gas onto the turbine wheel, the guide element comprises a first length region in the axial direction of the turbine, in which the guide element is designed with respect to its aerodynamic properties differently from its aerodynamic design in a second length region adjoining the first length region.

8 Claims, 19 Drawing Sheets

(56) References Cited

U.S. PATENT DOCUMENTS

| | | | | |
|---|---|---|---|---|
| 2008/0317593 | A1 | 12/2008 | Lombard et al. | |
| 2009/0077966 | A1 | 3/2009 | Lombard et al. | |
| 2011/0110766 | A1 | 5/2011 | Moore et al. | |
| 2011/0194929 | A1 | 8/2011 | Denholm et al. | |
| 2013/0177403 | A1* | 7/2013 | Olmstead | F01D 17/16 415/159 |

* cited by examiner

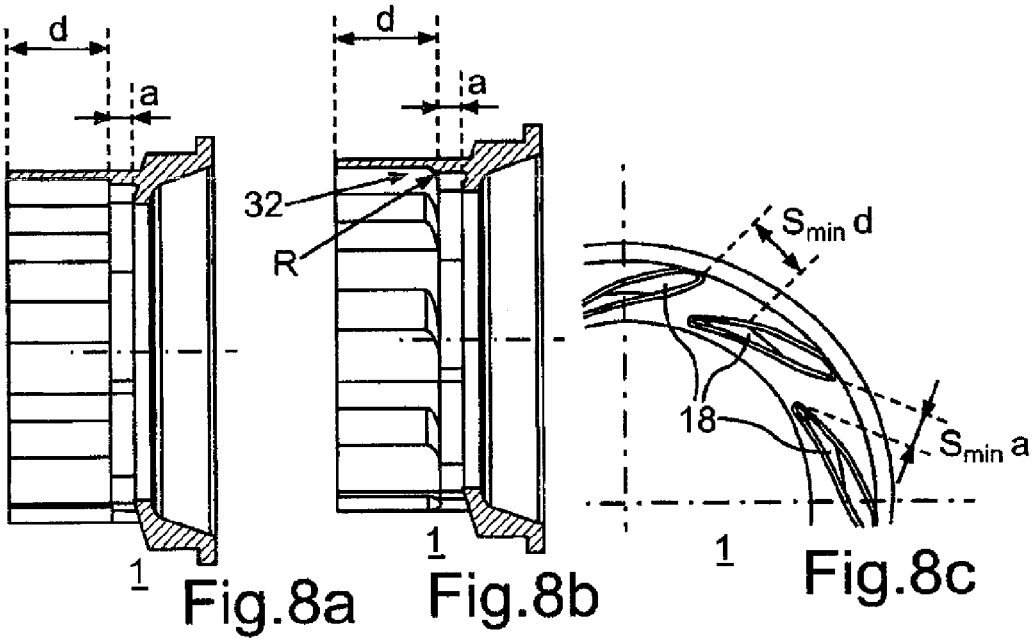
d
a
1
Fig.8a
d
a
32
R
1
Fig.8b
$S_{min}$ d
18
$S_{min}$ a
1
Fig.8c
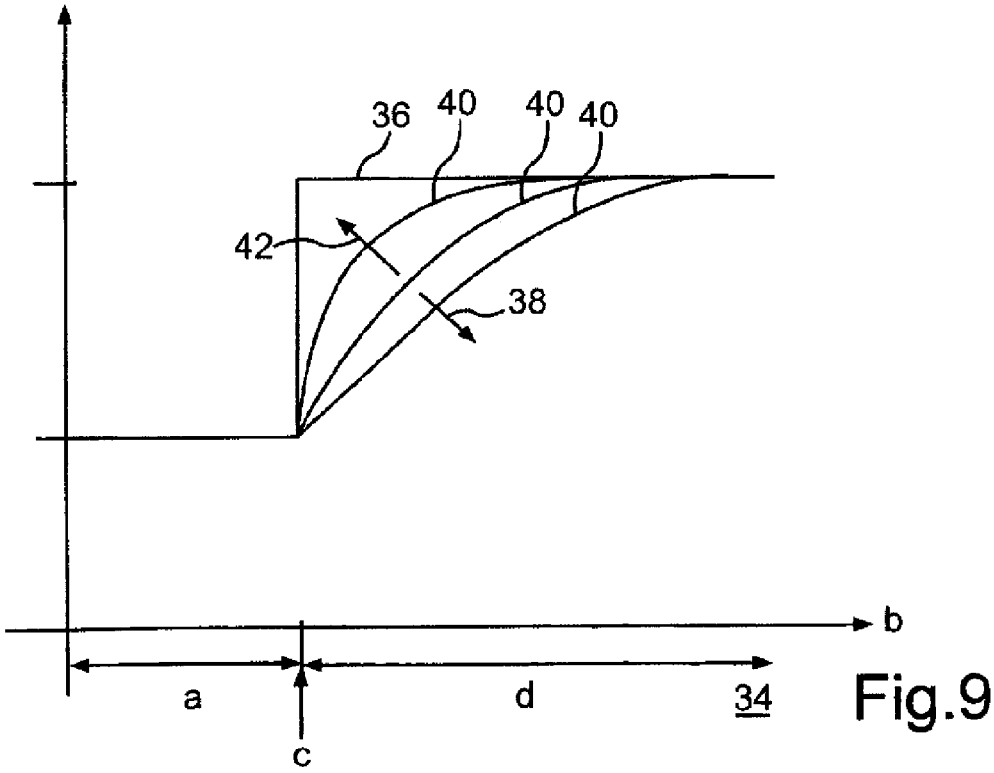
36
40
40
40
42
38
b
a
d
34
c
Fig.9

18
d
f
a
1

46
12
4
5
d
30
18
a
1
2
$D_{zd}$
c
10
16
9
50
$D_{za}$ a
f
18
d
1

50
54
46
12
2
1
10
5
30
4
18
d
a
16
9
52
f

TURBINE FOR AN EXHAUST GAS TURBOCHARGER

This is a Continuation-In-Part application of pending international patent application PCT/EP2012/003970 filed Sep. 22, 2012 and claiming the priority of German patent application 10 2011 120 553.9 filed Aug. 12, 2011.

BACKGROUND OF THE INVENTION

The invention relates to a turbine for an exhaust gas turbocharger with a turbine casing including a turbine wheel and a vehicle exhaust gas supply passage conducting the exhaust gas to the turbine wheel via a feed passage.

From the series production of combustion engines it is known to employ exhaust gas turbochargers for charging the combustion engines. The exhaust gas turbochargers each comprise a turbine and a compressor. The turbine may be driven by the exhaust gas of the combustion engine. The compressor may be driven via the turbine in order to compress air to be supplied to the combustion engine. This allows the utilization of energy contained in the exhaust gas of the combustion engine so that fuel consumption and $CO_2$ emission may be kept low.

For achieving particularly low fuel consumption values and thus low $CO_2$ emissions the combustion engines are designed in accordance with the so-called down-sizing principle, that is, their sizes are minimized. Here, the combustion engines have a very small engine displacement but because of the compressed air they may provide relatively high specific torque and output power values. Due to the high specific power output the requirements to be met by the exhaust gas turbochargers and in particular by their turbines are increasing. A challenge which must not be underestimated is the realization of a satisfactory instationary behavior of the turbines so that the combustion engines exhibit a good driving behavior.

For Otto engines as well as for Diesel engines, turbines with variable turbine geometries are employed in order to be able to adapt the turbines to various operating points of the combustion engine. Compared to a Diesel engine a variable turbine of an Otto engine must, however, have a particularly wide flow rate range. In particular for achieving an acceptable instationary behavior, e. g. during vehicle acceleration, it is advantageous, in particular in the turbine operating range of low flow rate parameters, i. e. at relatively small flow cross-sections of the turbine, to achieve turbine efficiencies as high as possible.

EP 1 301 689 B1 discloses a turbine of an exhaust gas turbocharger with a turbine casing. The turbine casing comprises a receiving chamber for accommodating a turbine wheel as well as a volute through which the exhaust gas may flow. The turbine further comprises a guide vane mechanism which may be moved in the axial direction, by means of which the exhaust gas flowing from the volute to the turbine wheel may appropriately be directed. This turbine exhibits an inefficient operation.

It is the principal object of the present invention to provide a turbine for an exhaust gas turbocharger which provides for a particularly efficient operation.

SUMMARY OF THE INVENTION

Such a turbine for an exhaust gas turbocharger comprises a turbine casing which comprises a receiving chamber for accommodating a turbine wheel and at least one volute through which exhaust gas may flow. The exhaust gas is guided by the volute into the receiving chamber via a feed passage which is in fluid communication with the volute, at least one guide element for guiding the exhaust gas is provided which is fixed relative to the turbine casing and projects into the feed passage at least in a guide region. The guide element comprises a first length region in the guide region in the axial direction of the turbine, in which the guide element is shaped with respect to its aerodynamic properties differently from the way it is shaped in a second length region of the guide element adjoining the first length region.

Preferably a slide element is provided which is movable in the axial direction relative to the turbine casing between an open position which maximally opens a flow cross-section of the feed passage in both length regions and a closed position which maximally restricts and merely opens the flow cross-section in the first length region. Here, the length regions are designed such with respect to their aerodynamic properties in such a way that generation of swirling is at least essentially maintained by means of the length regions when the slide element is moved from the closed position in which swirling is generated to the open position.

In particular at the beginning of the movement of the slide from the closed position, in which the turbine is adjusted for a minimal flow rate, into the open position no or only a very slight decrease of the swirl generation and thus of an inlet swirl of the flow of the exhaust gas occurs so that the output power of the turbine decreases only negligibly. The inventive turbine may therefore be operated efficiently and with high turbine efficiencies. Furthermore, it exhibits an advantageous instationary behavior.

Preferably, in the closed position the slide element covers the guide element relative to the radial direction of the turbine only at one side at least partially. In other words, the slide by means of which the second length region is covered in the closed position is arranged only on one side of the guide element relative to the radial direction of the turbine. Leakage flows at function gaps which would have to be provided for a cover on both sides of the guide element can therefore be prevented. This is beneficial for the efficient operation of the inventive turbine.

The invention will become more readily apparent from the following description of a preferred exemplary embodiment thereof with reference to the accompanying drawings. The features and feature combinations as previously mentioned in the description as well as the features and feature combinations which will be mentioned in the following description of the figures and/or which are solely illustrated in the figures are not only applicable in the respective indicated combination but also in other combinations or isolated, without deviating from the scope of the invention.

BRIEF DESCRIPTION OF THE DRAWING

FIGS. 8*a-b* each show a schematic longitudinal sectional view of an embodiment of a guide vane mechanism according to FIG. 7*c;*

FIG. 8*c* shows a portion of a schematic plan view of a guide vane mechanism according to FIGS. 8*a-b;*

FIG. 9 shows a schematic diagram for illustrating the correlation between the distance of guide vanes of the guide vane mechanism according to FIGS. 8*a-c* and the width of a nozzle of the turbine according to FIGS. 7*a-c*, via which exhaust gas from a volute of the turbine flows into a receiving chamber for accommodating a turbine wheel;

DESCRIPTION OF EXEMPLARY EMBODIMENTS

Figure 1B:
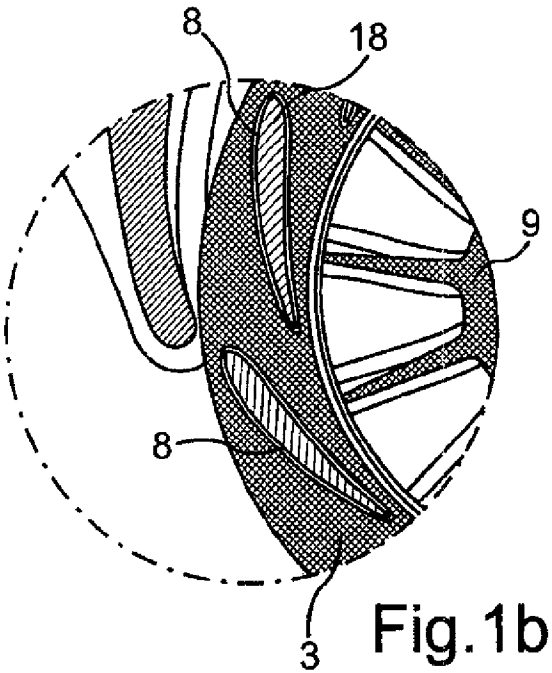
FIG. 1*b* shows a portion of a schematic cross-sectional view of the turbine according to FIG. 1*a;*
Figure 1A:
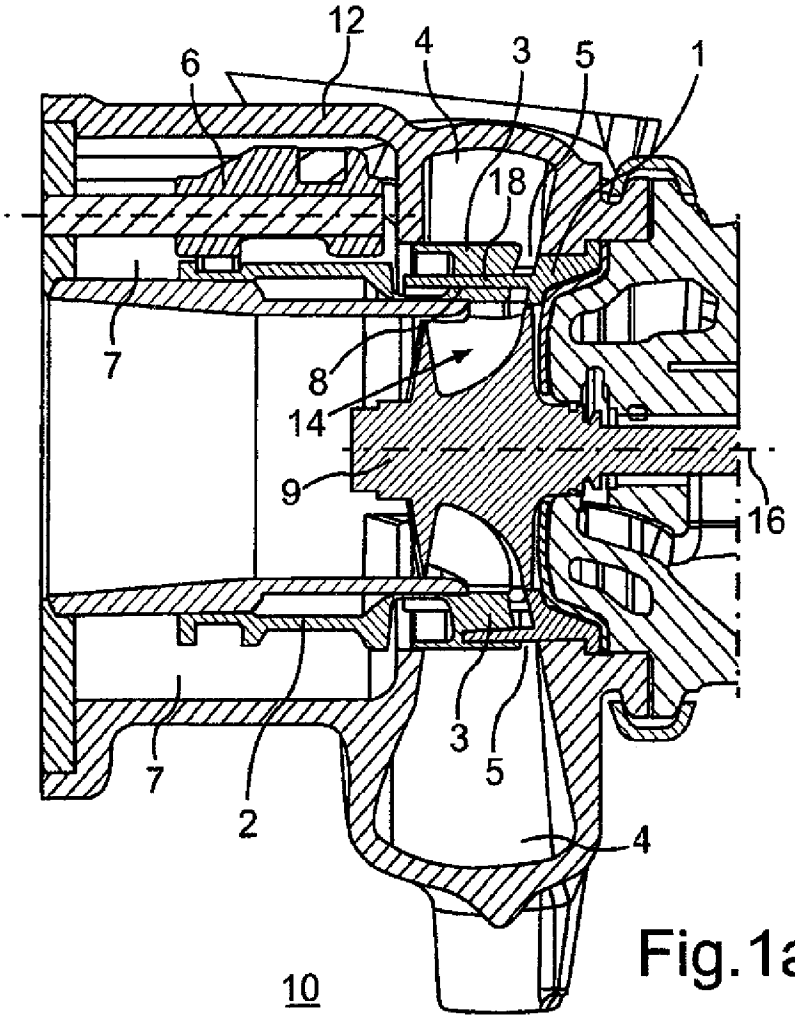
FIG. 1*a* shows a schematic longitudinal sectional view of a turbine of an exhaust gas turbocharger for a combustion engine, in particular of an automobile.

FIG. 1*a* shows a turbine 10 for an exhaust gas turbocharger of a combustion engine for an automobile. The turbine 10 comprises a turbine casing 12 which comprises a receiving chamber 14. A turbine wheel 9 of the turbine 10 is accommodated in the receiving chamber 14 rotatably about an axis of rotation 16 relative to the turbine casing 12. The turbine 10 comprises a guide vane mechanism or element 1 arranged at a bearing housing side or the turbine 10, which comprises a plurality of guide vanes 18.

The turbine casing 12 further comprises an inlet duct 4 through which exhaust gas of the combustion engine enters the turbine. The inlet duct 4 is also referred to as volute and extends at least essentially spiral-shaped in the circumferential direction of the turbine wheel 9 over its circumference. A flow duct which is also referred to as feed passage 5 is in fluid communication with the volute 4. The exhaust gas flowing through the volute 4 is guided via the feed passage 5 to the receiving chamber 14 and the turbine wheel 9. The feed passage 5 may also be referred to as nozzle. An effective cross-section of the feed passage 5, i. e. its nozzle width b, determines the pressure build-up behavior of the turbine 10.

Here, the effective cross-section of the feed passage 5 of the turbine 10 is variably adjustable. For this purpose, the turbine 10 comprises an axial slide 2 with a matrix 3 into which the guide vanes 18 may project.

The axial slide 2 may be moved in the axial direction of the turbine 10 relative to the turbine casing 12 and is movable between a closed position (first end stop) maximally restricting the effective cross-section and an open position (second end stop) maximally opening the effective cross-section of the feed passage 5. For moving the axial slide 2 and for varying the pressure build-up behavior of the turbine 10, an adjusting mechanism 6 is provided which is accommodated in an adjustment chamber 7.

In order to ensure the movability of the axial slide 2 during the operation of the turbine 10 a circumferential function gap 8 is provided between the guide vane mechanism 1, or the guide vanes 18, respectively, and the matrix 3. The circumferential function gap 8 may, however, cause secondary flow losses at the guide vane mechanism 1, i. e. part of the exhaust gas mass flow does not flow directed into the turbine wheel 9—as desired—through the guide vane mechanism 1 or via the guide vanes 18, respectively, but undirected via the circumferential function gap 8 into the turbine wheel 9. This incorrect inflow inevitably leads to undesired low turbine efficiencies, in particular in operating ranges with low turbine flow rate parameters as are prevailing with a closed axial slide 2.

The guide vane mechanism 1 with the guide vanes 18 is a so-called swirl generator which in particular by means of the guide vanes 18 generates an inlet swirl at the inlet of the turbine wheel 9. This causes a particularly efficient flow into the turbine wheel 9. If the exhaust gas flows past the guide vane mechanism 1 and is not subjected to swirl generation, this will negatively influence the efficient operation of the turbine 10.

Basically, a guide apparatus comprising the guide vane mechanism 1 and the matrix 3 poses demanding requirements for production technology in order to reliably cope with the high operating temperatures in particular of an Otto engine and to simultaneously minimize losses such as secondary flow losses.

It is therefore desirable to use a shroud element for adjusting the flow cross-section of the feed passage 5 which may cover the guide vane mechanism 1 merely on one side, preferably in the flow direction of the exhaust gas to the turbine wheel 9 upstream of the guide vanes 18, and not a matrix 3 which covers the guide vane mechanism 1 in the radial direction of the turbine 10 on both sides. This eliminates the need for a function gap 8, and secondary flow losses may be prevented or at least be kept small.

Figure 2:
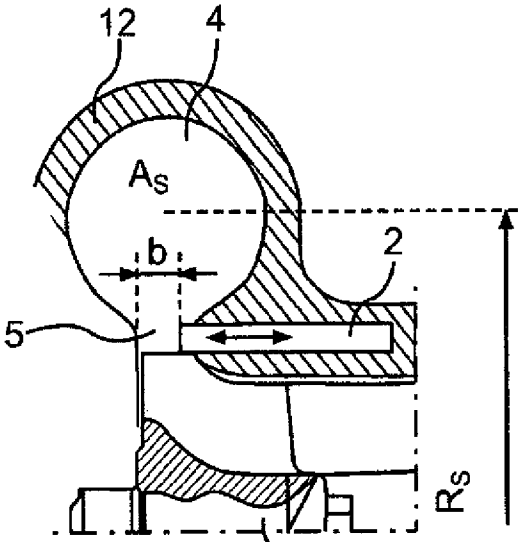
FIG. 2 shows a portion of a schematic longitudinal sectional view of another embodiment of the turbine according to FIGS. 1*a-b;*

FIG. 2 illustrates such a turbine 10, wherein the axial slide 2 is provided. The turbine 10 does, however, not comprise a guide vane mechanism 1 with guide vanes 18. This means, that the axial slide 2 has no blades. In FIG. 2 the nozzle width b of the feed passage 5 is indicated. FIG. 2 also shows a throat cross-section $A_S$ of the volute 4.

Figure 3:
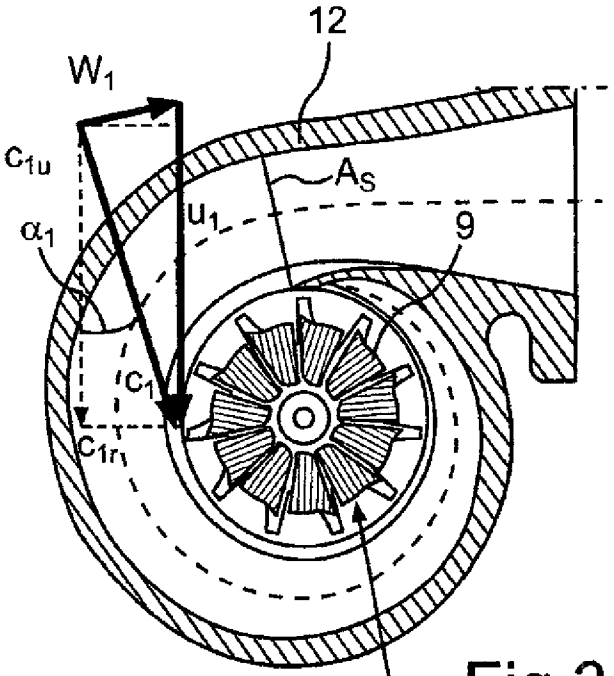
FIG. 3 shows a schematic cross-sectional view of another embodiment of the turbine according to FIG. 2.

As can be seen in conjunction with the velocity triangle of FIG. 3, there is a problem with the turbine 10 according to FIG. 2 in that a strong dependency exists between the inlet swirl to the turbine wheel 9 and the nozzle width b, which, due to the correlations described in the Euler turbo-machine equation, leads to a heavy drop of the turbine output power or the turbine efficiencies, respectively, at low values of the nozzle width b.

On the basis of the specific work according to Euler:

$$a_u = u_1 * c_{1u} - u_2 * c_{2u}$$

-continued and:

$$\tan\alpha_1 = \frac{c_{1r}}{c_{1u}} = \frac{A_S}{R_s} * \frac{\rho_S}{\rho_1} * \frac{1}{2 * \Pi * b}$$

it follows that the volute 4 generates swirl or imparts the circumferential component $c_{1u}$, respectively, on the flow of the exhaust gas according to its geometric features throat cross-section $A_S$, centroid radius $R_s$ as well as in relation to the nozzle width b.

Figure 4:
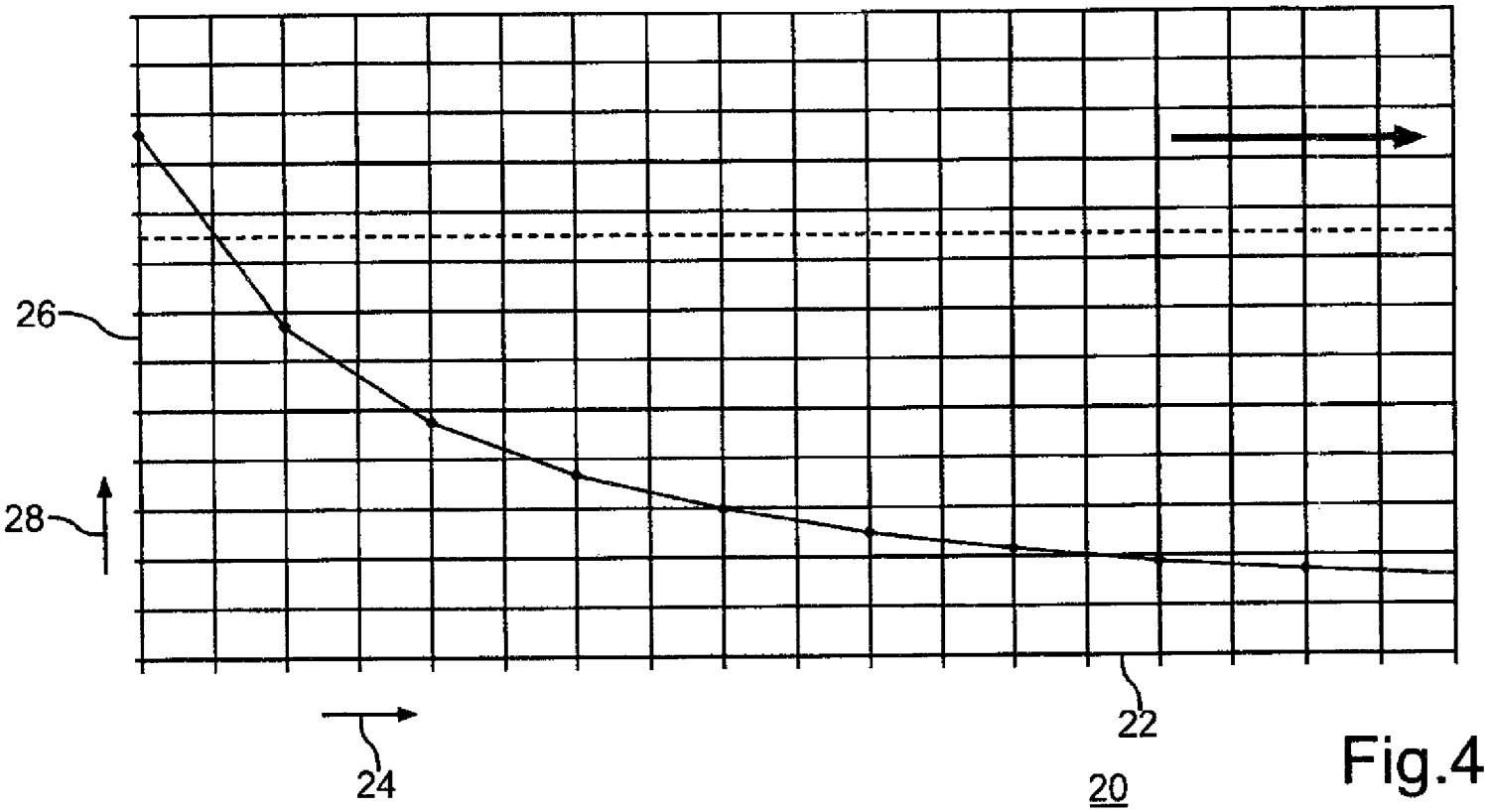
FIG. 4 shows a schematic diagram for explaining the correlation between the swirl generation and the movement of an axially movable slide of the turbine according to FIG. 2.

This can be clearly seen in particular in FIG. 4. FIG. 4 shows a first diagram 20 on whose first abscissa 22 the nozzle width b is plotted in ascending order in the direction of a first direction arrow 24. On the first ordinate 26 of the first diagram 20 the angle $\alpha_1$ is plotted according to a second direction arrow 28 in ascending order. If the axial slide 2 according to FIG. 2 is closed the nozzle width b is small. The angle $\alpha_1$ is large which results in a low circumferential component $c_{1u}$. Without the guide vane mechanism 1, this results in low turbine output power values or low turbine efficiencies, respectively.

If, on the other hand, the axial slide 2 is widened further, then the nozzle width b is large. The angle $\alpha_1$ is small which results in a high circumferential component $c_{1u}$. This means that the volute 4 diverts the exhaust gas accordingly and that no further diversion or deflection, respectively, of the exhaust gas by the guide vane mechanism 1 is required. In other words, a diversion or deflection, respectively, of the exhaust gas flow by means of the guide vane mechanism 1 is appropriate at small openings widths of the slide 2. At large opening widths, on the other hand, the swirl generation is to be effected solely via the volute 4 upstream of the guide vane mechanism 1.

Figure 5A:
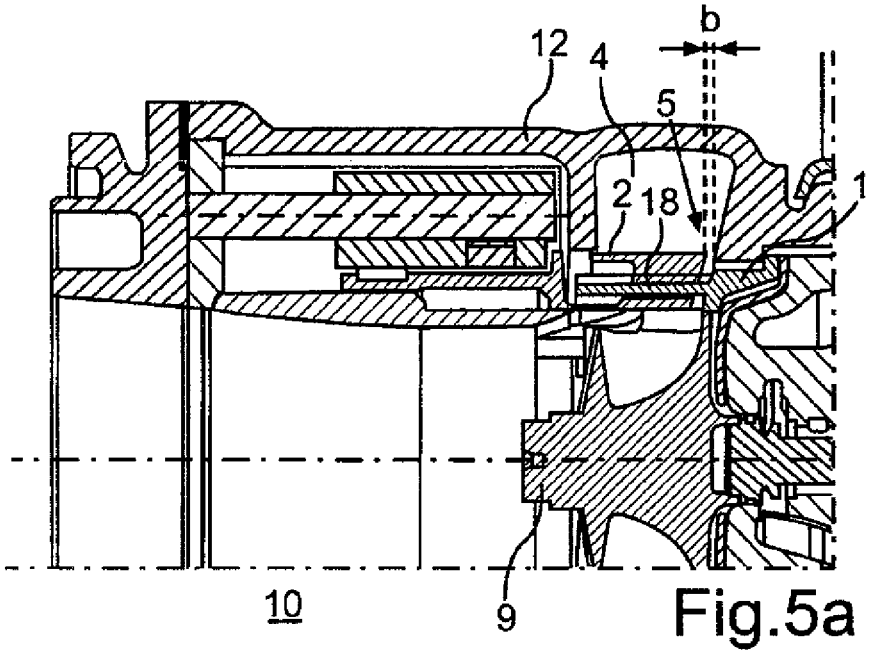
FIGS. 5*a-b* each show portions of a schematic longitudinal sectional view of the turbine according to FIG. 2.
Figure 5B:
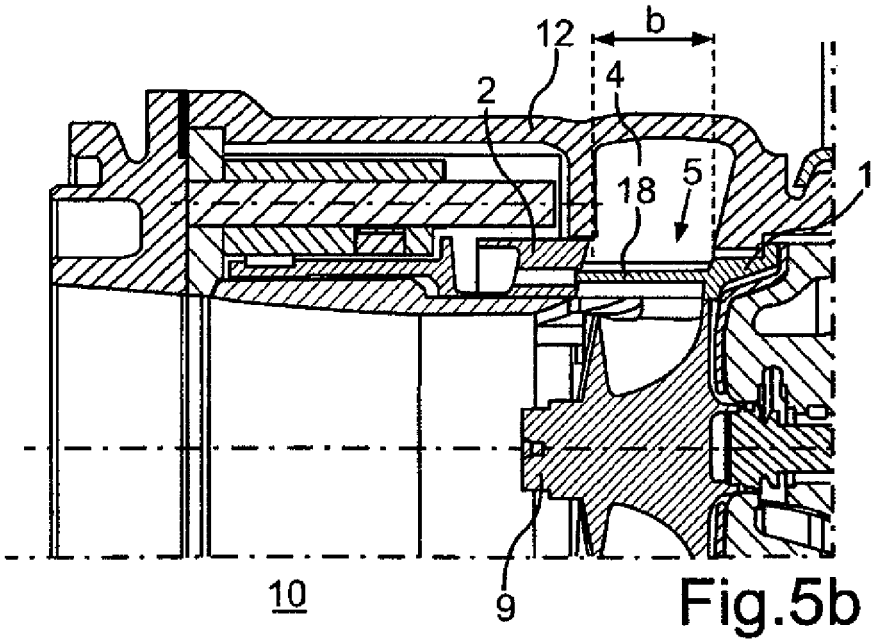

To demonstrate this correlation between nozzle width b and swirl generation, FIGS. 5*a-b* show the adjustment range or the extreme positions of the slide for the standard configuration of the turbine.

Based on the above explained correlation, a configuration is conceivable, wherein swirl generation is achieved solely by the guide vane mechanism only in the extreme position "slide closed", while, upon lift-off of the slide from the front end seat at the guide vane mechanism, swirl is generated via the volute.

Here, however, the behavior of the turbine 10 after lift-off of the axial slide from the closed position, i. e. at least essentially immediately after moving of the axial slide 2 from the closed position into the open position, can be problematic. The inlet swirl and thus the turbine output break down, because of the then prevailing opening width of the axial slide 2 the nozzle width b is too small for the generation of a desired and sufficient circumferential component $c_{1u}$.

Figure 6A:
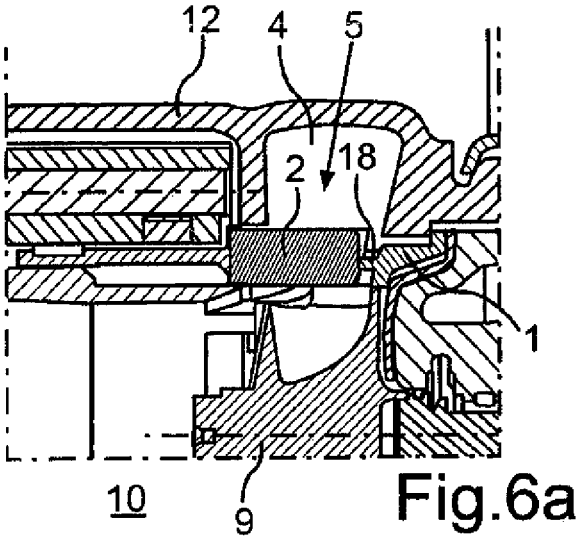
FIGS. 6*a-b* each show portions of a schematic longitudinal sectional view of another embodiment of the turbine according FIGS. 5*a-b;*
Figure 6B:
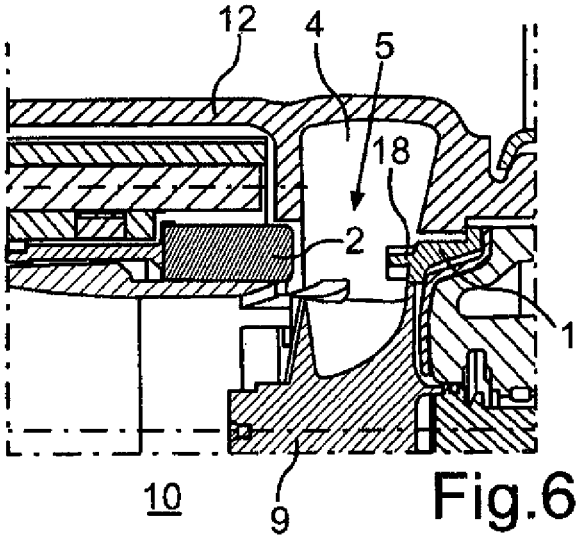

This is illustrated in FIGS. 6*a-b*. The guide vanes 18 of the guide vane mechanism 1 project only partially into the feed passage 5. In the closed position of the axial slide 2 the exhaust gas exclusively flows across the guide vanes 18. When the axial slide 2 has been moved from the closed position into at least one open position in which the nozzle width b is wider compared to the closed position then an unbladed region of the feed passage 5 is unblocked so that the exhaust gas may flow into the turbine wheel 9 both in a directed state across the guide vanes 18 and in an undirected state or merely in a swirled state generated by the volute 4, respectively.

Figure 7B:
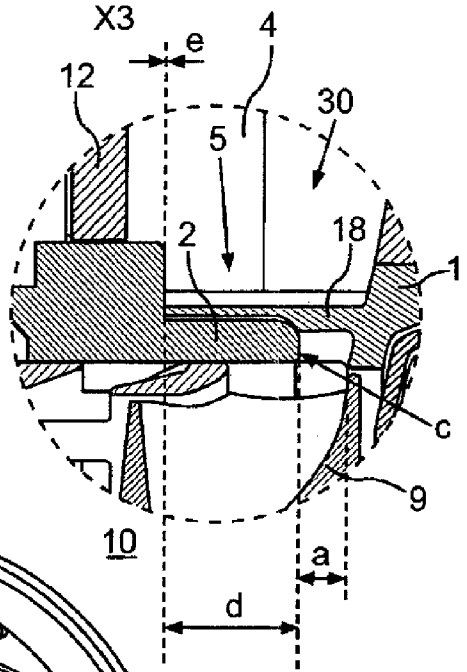
FIG. 7*b* shows a portion of another schematic longitudinal sectional view of the turbine according to FIG. 7*a;*
Figure 7C:
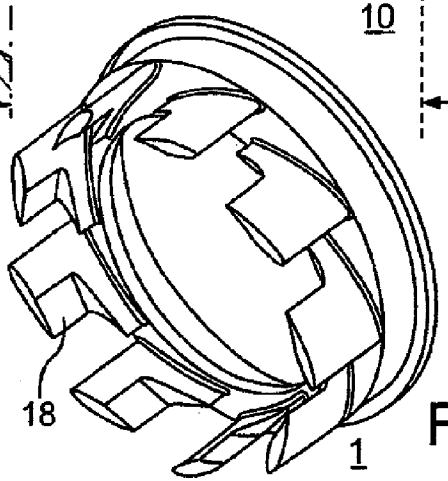
FIG. 7*c* shows a schematic perspective view or a guide vane mechanism of the turbine according to FIGS. 7*a-b:*
Figure 7A:
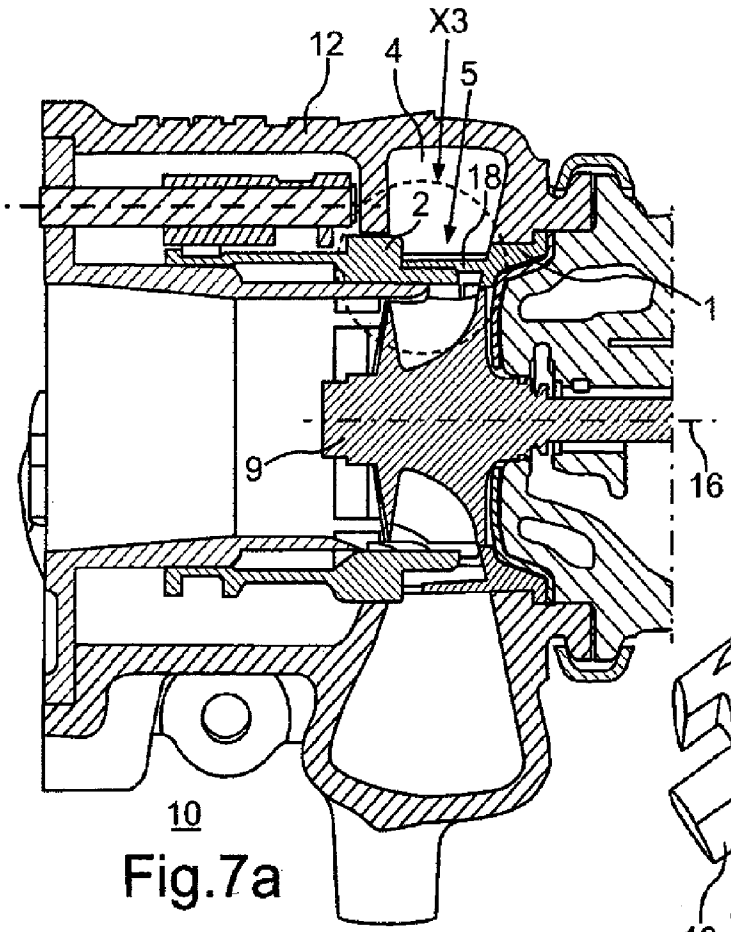
FIG. 7*a* shows a schematic longitudinal sectional view of another embodiment of the turbine according to FIG. 1*a;*

FIGS. 7*a*-7*c* show possibilities of preventing or at least minimizing the described breakdown of the inlet swirl and the turbine output power.

As can be seen in particular in FIG. 7*b*, the turbine 10 comprises the guide vane mechanism 1 with the guide vanes 18, which is fixed relative to the turbine casing 12. The guide vanes 18 project in a guide region 30 into the feed passage 5 and serve to deflect or divert, respectively, the exhaust gas, i. e. to generate swirl.

The guide vanes 18 comprise a first length region a and an adjoining second length region d relative to the axial direction of the turbine 10 starting from the bearing housing side of the turbine 10, which extend in the axial direction and which are adjoining each other in the axial direction. With respect to the aerodynamic properties, the first length region of the guide vanes 18 is designed different from the second length region d. In other words, the guide vanes 18 differ in the length regions a, d with respect to their respective aerodynamic properties.

The length regions a, d are in particular designed in such a manner with respect to their axial extension that a required minimum value of the flow rate parameter of the turbine 10 for the combustion engine assigned to the turbine 10 is established when the axial slide 2 is in the closed position of FIG. 7*b* and in contact with an axial stop c of the guide vanes 18. In this closed position the exhaust gas from the volute 4 flows only in the length region a to the turbine wheel 9. This means that in the closed position of the axial slide 2 the inlet swirl to the turbine wheel 9 is exclusively applied via the length region a, so that at least essentially ideal conditions without secondary flow losses are obtained.

Here, the length region d has the function to maintain the inlet swirl at lift-off of the axial slide 2 from the stop c, i, e. during movement of the axial slide 2 from the closed position into an open position which also opens the length region d at least partially, and thus to minimize or prevent the above described efficiency or power breakdown.

As can be seen in FIG. 7*c*, the guide vanes 8 in the length regions a, d differ in particular with respect to their extension in the circumferential direction. In other words, the guide vanes 18 in the second length region d are shorter than in the first length region a relative to the circumferential direction.

As can be seen in FIGS. 8*a*-9, different minimum guide vane distances $s_{min}$ are shown in the length regions a, d of the guide vanes 18. A first minimum guide vane distance $s_{min_a}$ in the first length region a is smaller than a second minimum guide vane distance $s_{min_a}$ in the second length region d. Here, the effective cross-section of the guide vane mechanism 1 results from the geometric parameters of the nozzle width b as a function of the travelling distance of the axial slide 2 as well as the minimum guide vane distance $s_{min}$. For obtaining a favorable turbine characteristic over the entire travelling distance of the axial slide 2—free from significant efficiency drops—it is advantageous to design the transition between the length regions a, d as smooth as possible, i. e. to prevent an abrupt or stepwise, respectively, change starting e. g. from the first length region a towards the second length region d and thus of the minimum guide vane distance $s_{min}$.

As can be seen in FIG. 8*b*, it is advantageously provided that a transition region 32 via which the length regions a, d are connected with each other has a radius and is correspondingly at least essentially formed in the shape of a circular arc. In another suitable configuration this transition region 32 may in particular be formed elliptical.

A second diagram 34 of FIG. 9 shows a qualitative course of the minimum guide vane distance $s_{min}$ which is plotted over the nozzle width b. A stepwise transition which is characterized by a first course 36 between the length regions a, d leads to a sharp increase of the guide vane distance $s_{min}$. By providing the radius R at the guide vanes 18 a smooth course of the minimum guide vane distance $s_{min}$ between the length regions a, d may be achieved. Here, a third direction arrow 38 indicates an increase of the radius R which is accompanied by a change of the first course 36 to other courses 40. Conversely, a fourth direction arrow 42 indicates the continuous decrease of the radius R and thus the behavior of the other courses 40 towards the first course 36.

Figure 10:
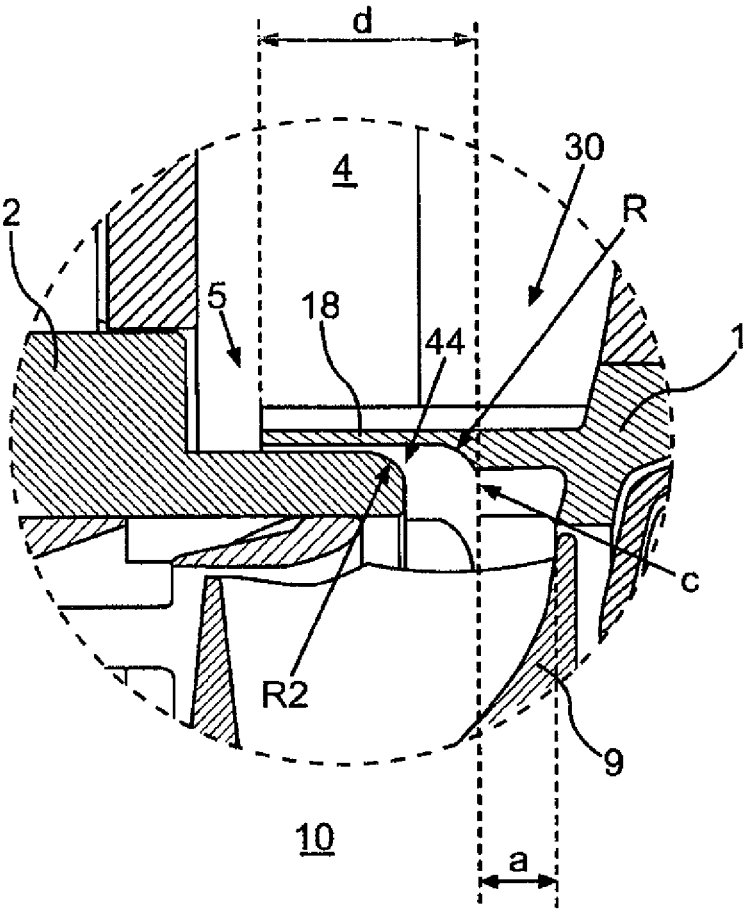
FIG. 10 shows a portion a schematic longitudinal sectional view of another embodiment of the turbine according to FIGS. 7*a-c;*

According to FIG. 10, the axial slide 2 comprises a front end 44 with another radius R2. Thus, the front end 44 of the axial slide 2 is also formed at least essentially arc-shaped, in particular circular arc-shaped or elliptical. Advantageously, the radius R and the other radius R2 are equal. When the axial slide 2 is in its closed position at the stop c, with the turbine 10 being closed, the radii R, R2 at least essentially coincide.

Figure 11:
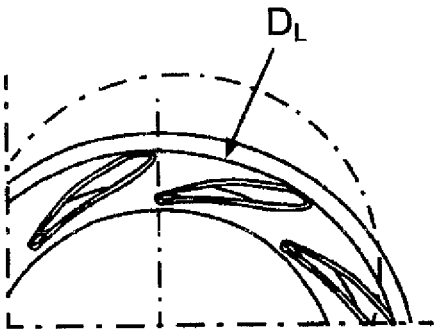
FIG. 11 shows a portion of a schematic plan view of a guide vane mechanism according to FIG. 7*c;*
Figure 12:
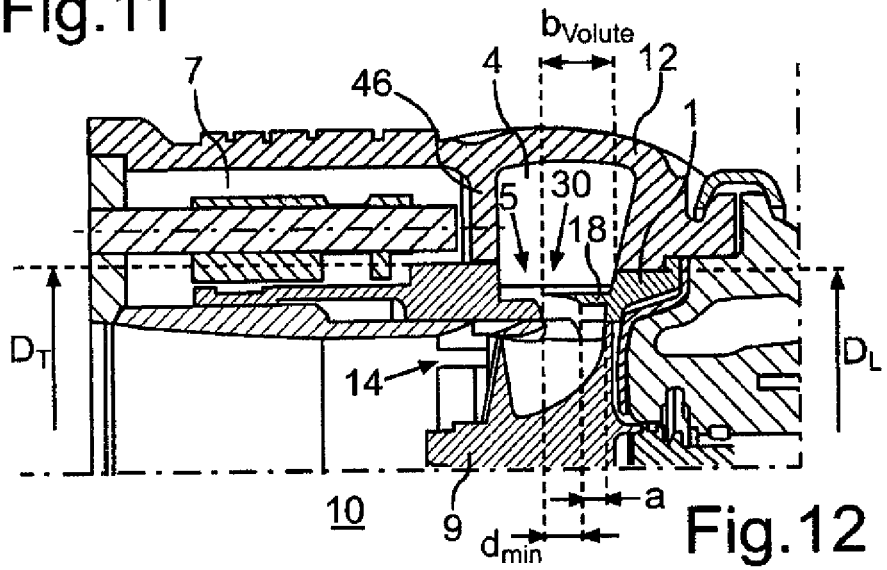
FIG. 12 shows a portion of a schematic longitudinal sectional view of another embodiment of the turbine according to FIG. 7*a;*
Figure 13:
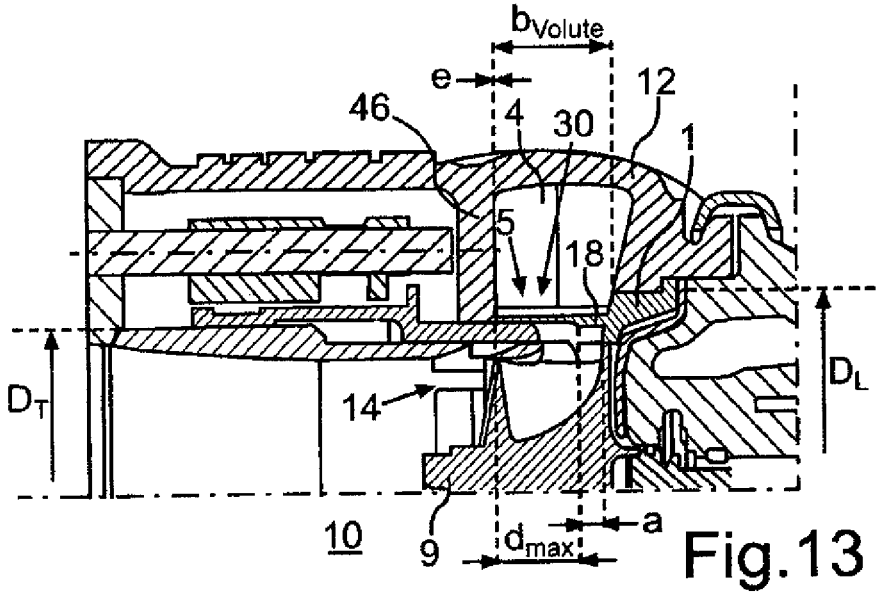
FIG. 13 shows a portion of a schematic longitudinal sectional view of another embodiment of the turbine according to FIG. 12.
Figure 14:
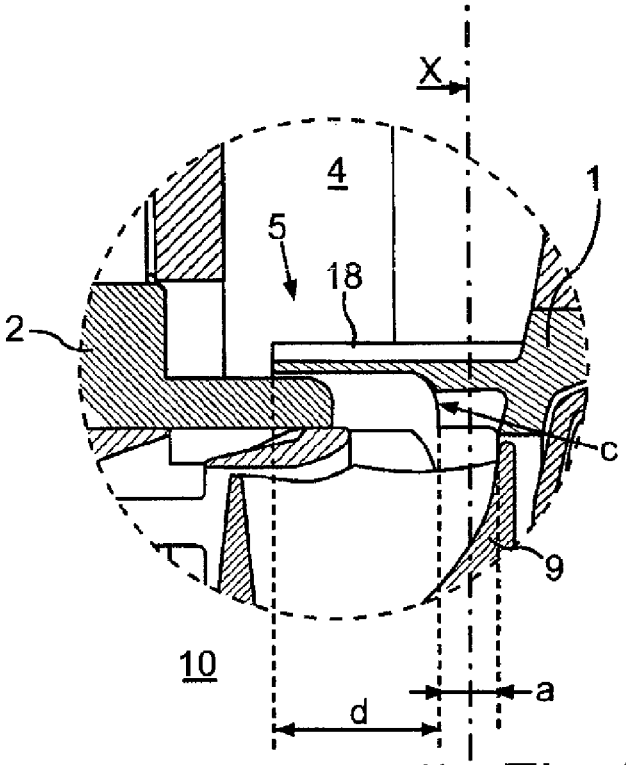
FIG. 14 shows a portion of a schematic longitudinal sectional view of the turbine according to FIG. 12.

The advantageous axial extension, i. e. the length of the second length region d, is shown in FIGS. 11-13. The second length region d advantageously has such a length that a volute nozzle width $b_{volute}$ is obtained in conjunction with the used ratio $A_S/R_S$ of the volute 4 and the axial extension (length) of the first length region a for the closed position which is pregiven for the engine application, i. e. at the transition of the outlet of the volute 4 to the guide vane mechanism 1, which leads to a predeterminable maximum value of the angle $\alpha_1$ which is the angle of outflow from the volute 4. In other words, the volute nozzle width $b_{volute}$ is so large that the angle $\alpha_1$ is smaller than or equal to 25°, i. e. maximal 25°. This is the case in particular as shown in FIG. 12 when an inner diameter $D_T$ of a partition wall 46 by means of the volute 4 and the adjustment chamber are fluidly separated is greater than or equal to an inlet diameter $D_L$ of the guide vane mechanism 1. This results in particular in a minimum extension $d_{min}$ of the second length region d.

As can be seen from FIG. 13, the length of the second length region d may also be selected in such a manner that the entire nozzle width b or the volute nozzle width $b_{volute}$, respectively, is covered by leading edges of the guide vanes 18. In this case, the partition wall 46 may end on a relatively small inner diameter $D_T$ in the radial direction, which is smaller than the inlet diameter $D_L$ of the guide vane mechanism. By this measure the respective end faces of the guide vanes 18 in the second length region d are able to abut against or at least essentially nearly abut, respectively, the partition wall 46 with the exception of another function gap e, whereby secondary flow losses in the second length region d are prevented or minimized, respectively.

This results, in particular, in a maximum axial extension $d_{max}$ of the second length region d. Another geometric feature of the guide vane mechanism 1 with the different length regions a, d is the degree to which the base profile of the guide vanes 18 over the extension of the second length region d is still utilized for maintaining swirl.

Figure 15:
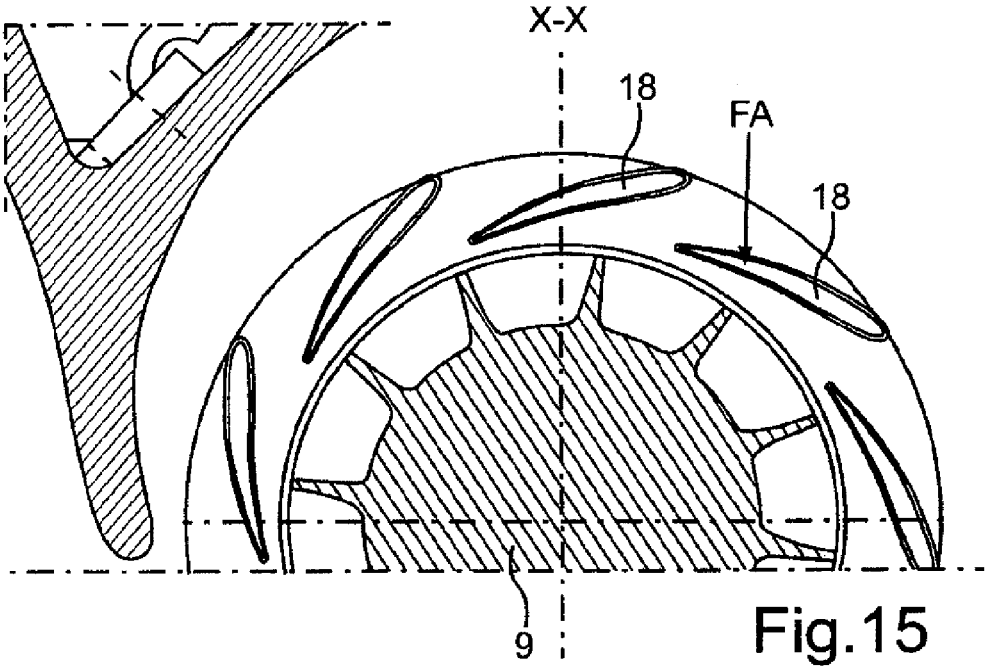
FIG. 15 shows a portion of a schematic cross-sectional view of the turbine according to FIG. 14 along line X-X shown in FIG. 14.
Figure 16:
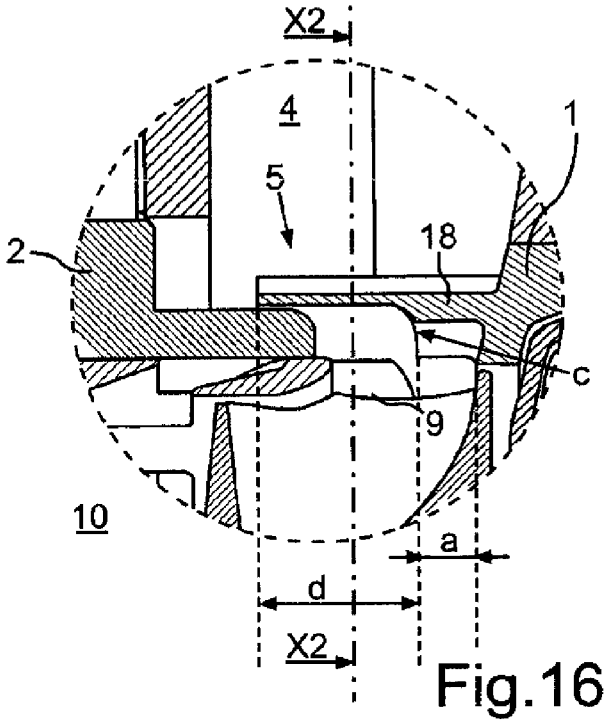
FIG. 16 shows a portion of another schematic longitudinal sectional view of the turbine according to FIG. 14.
Figure 17:
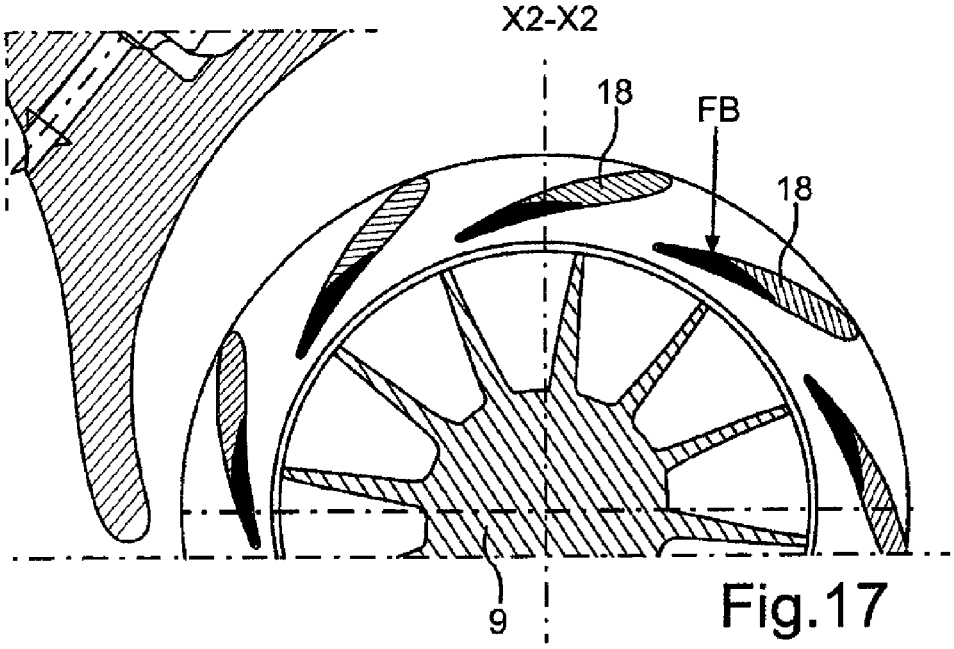
FIG. 17 shows a portion of a schematic cross-sectional view of the turbine according to FIG. 16 along line X2-X2 shown in FIG. 16.
Figure 19:
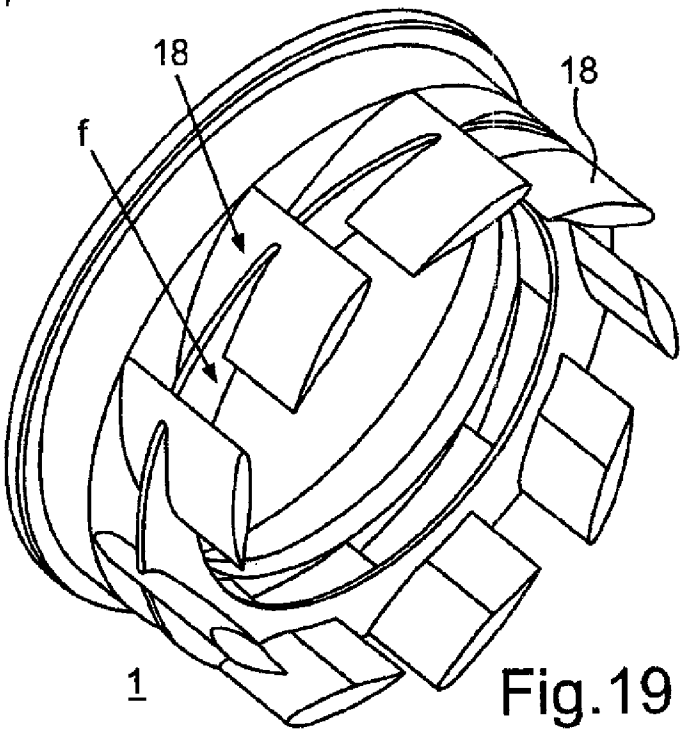
FIG. 19 shows a schematic perspective view of the guide vane mechanism of the turbine according to FIG. 18.

This degree is the reciprocal of the ratio of the first area FA shown in FIG. 15, which is enclosed by the profile which is fully utilized in the first length region a, i. e. of the first area FA around which the exhaust gas flows, and which extends at least essentially vertically to the axial direction, to the second area FB which is enclosed by the profile in the second length region d which the axial slide 2 covers or may cover, respectively, and which can be seen in FIG. 17. The reciprocal of the ratio of FA to FB is therefore FB/FA, with FB/FA being advantageously within the range of 10% to 75%.

Figure 18:
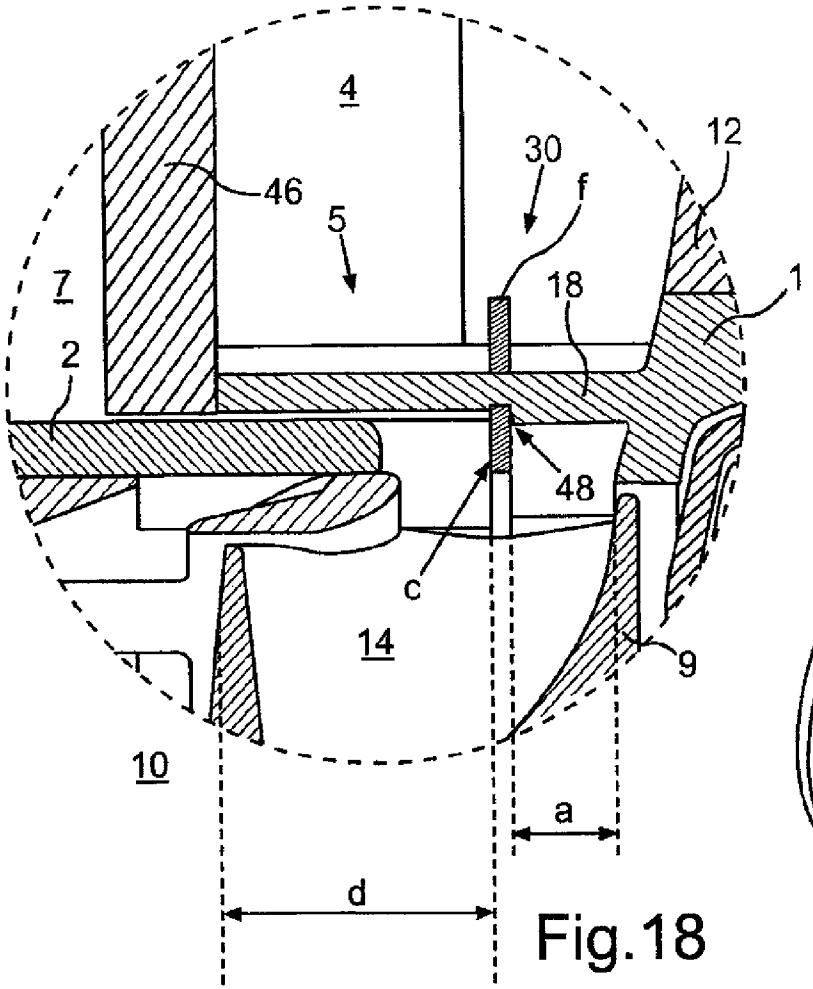
FIG. 18 shows a portion of a schematic longitudinal sectional view of another embodiment of a turbine according to FIG. 7*a;*
Figure 20:
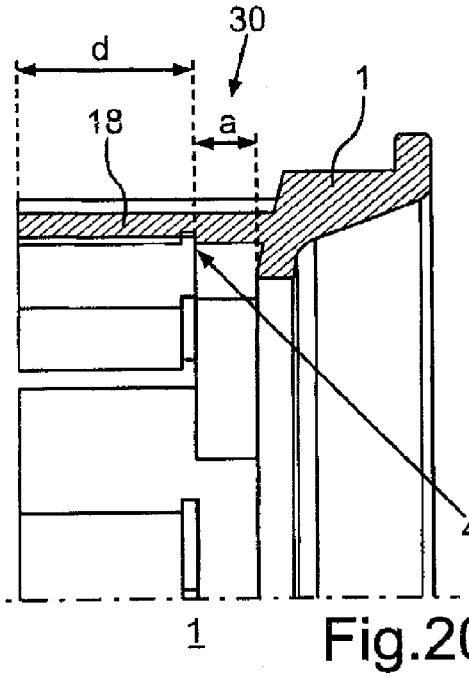
FIG. 20 shows a portion of a schematic longitudinal sectional view of another embodiment of the guide vane mechanism according to FIG. 19.
Figure 21:
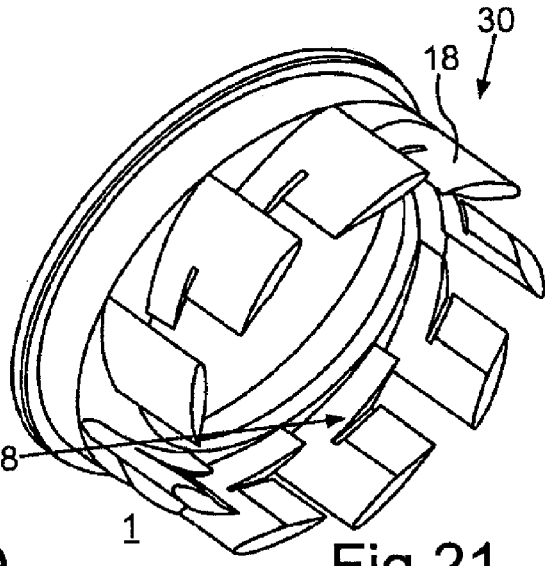
FIG. 21 shows a schematic perspective view of the guide vane mechanism according to FIG. 20.
Figure 22:
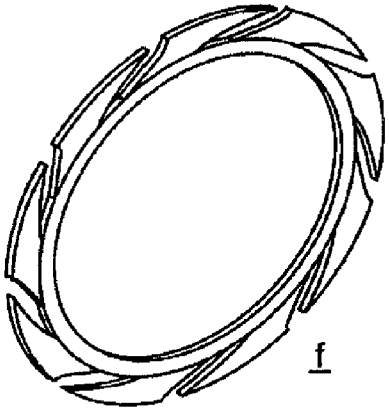
FIG. 22 shows a schematic perspective view of a dividing element for the guide vane mechanism according to FIGS. 20 and 21.
Figure 23:
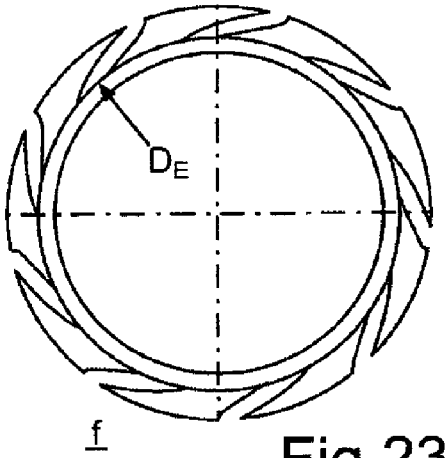
FIG. 23 shows a schematic plan view of the dividing element according to FIG. 22.
Figure 24A:
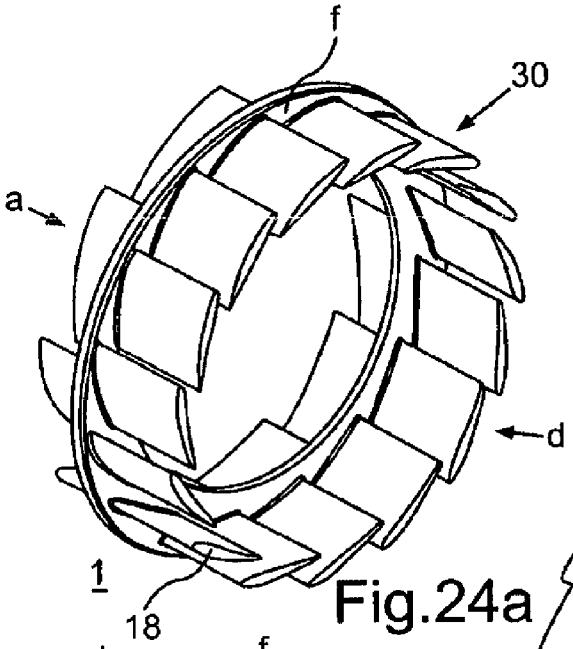
FIG. 24*a* shows a schematic perspective view of another embodiment of the guide vane mechanism according to FIG. 21.
Figure 24B:
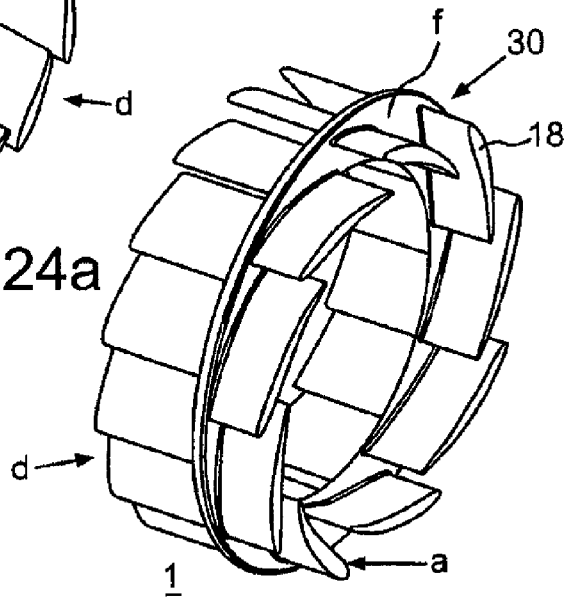
FIG. 24*b* shows another schematic perspective view of the guide vane mechanism according to FIG. 24*a:*
Figure 24C:
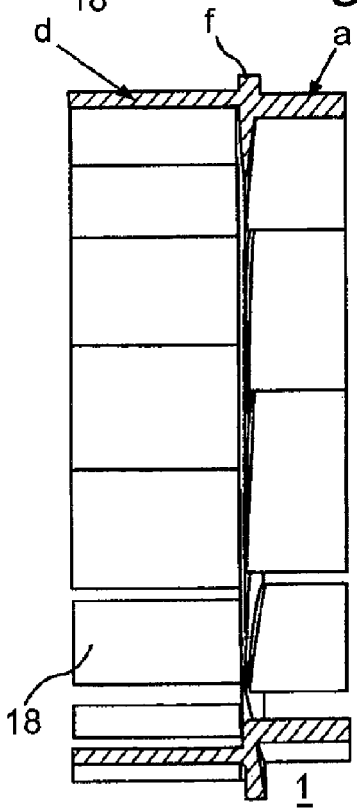
FIG. 24*c* shows a schematic longitudinal sectional view of the guide vane mechanism according to FIGS. 24*a-b;*
Figure 25B:
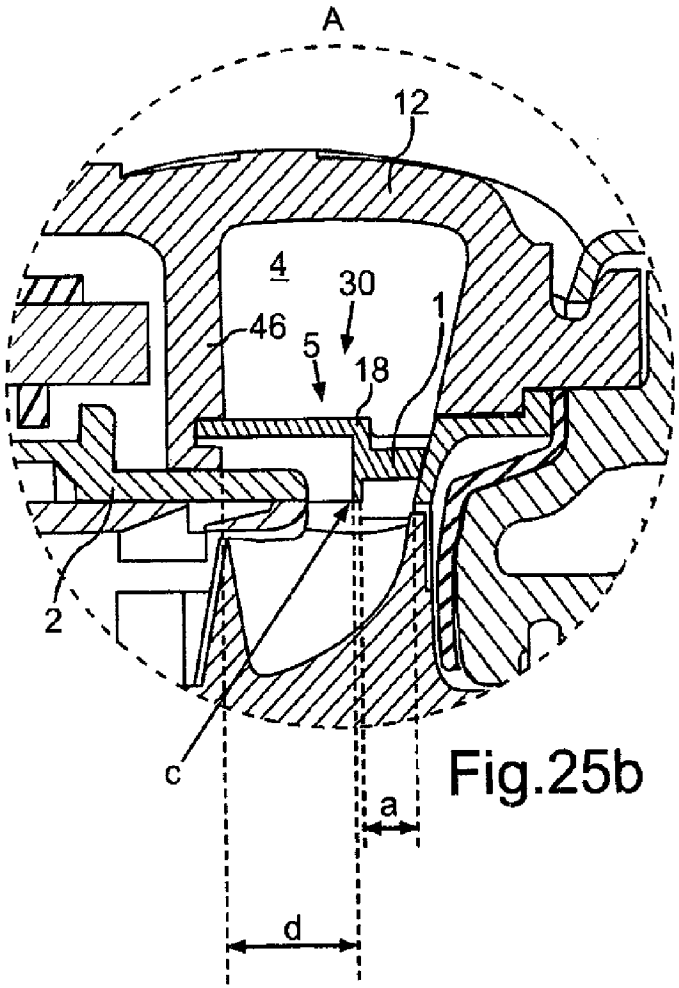
FIG. 25*b* shows a portion of a schematic longitudinal sectional view of the turbine according to FIG. 25*a;*
Figure 25A:
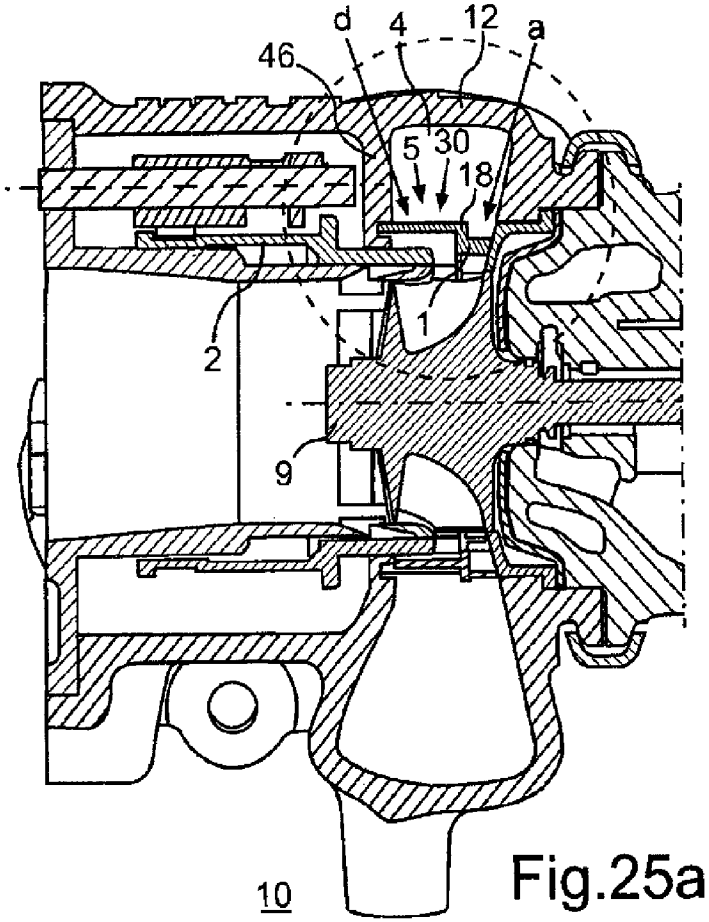
FIG. 25*a* shows a schematic longitudinal sectional view of another embodiment of the turbine according to FIG. 7*a;*

The turbine 10 according to FIG. 18 comprises a dividing element f for the flow separation of the length regions a, d. An area of the dividing element f facing, the axial slide 2 serves as stop c for the axial slide 2 in its closed position.

In various operating points or operating ranges, respectively, a force may act, i. a. due to gas dynamic forces, on the dividing element f in the axial direction, which is directed in the direction of the turbine outlet. This is in particular the case immediately after lift-off of the axial slide 2 from the closed position of the stop c, i. e. the dividing element is advantageously fixed in its axial position at the transition of the length regions a, d.

For this purpose, the dividing element f may be secured e. g. by a joining method such as e. g. welding at the guide vane mechanism 1 and/or at the individual guide vanes 18.

Alternatively, the guide vane mechanism 1, in particular the guide vanes 18, may have a groove 48 which is formed by machining, and in which the dividing element f is engaged and thus fixed in its axial position.

FIGS. 20 to 23 shows the circumferential groove 48 in the guide vanes 18, which is located directly at the transition of the two length regions a, d. In guide vanes matrices for accommodating the guide vanes 18 provided at the dividing element f, there is also an engagement diameter $D_E$, on which the dividing element f may engage in the groove 48 upon assembly.

Figures 26A, 26B, 27:
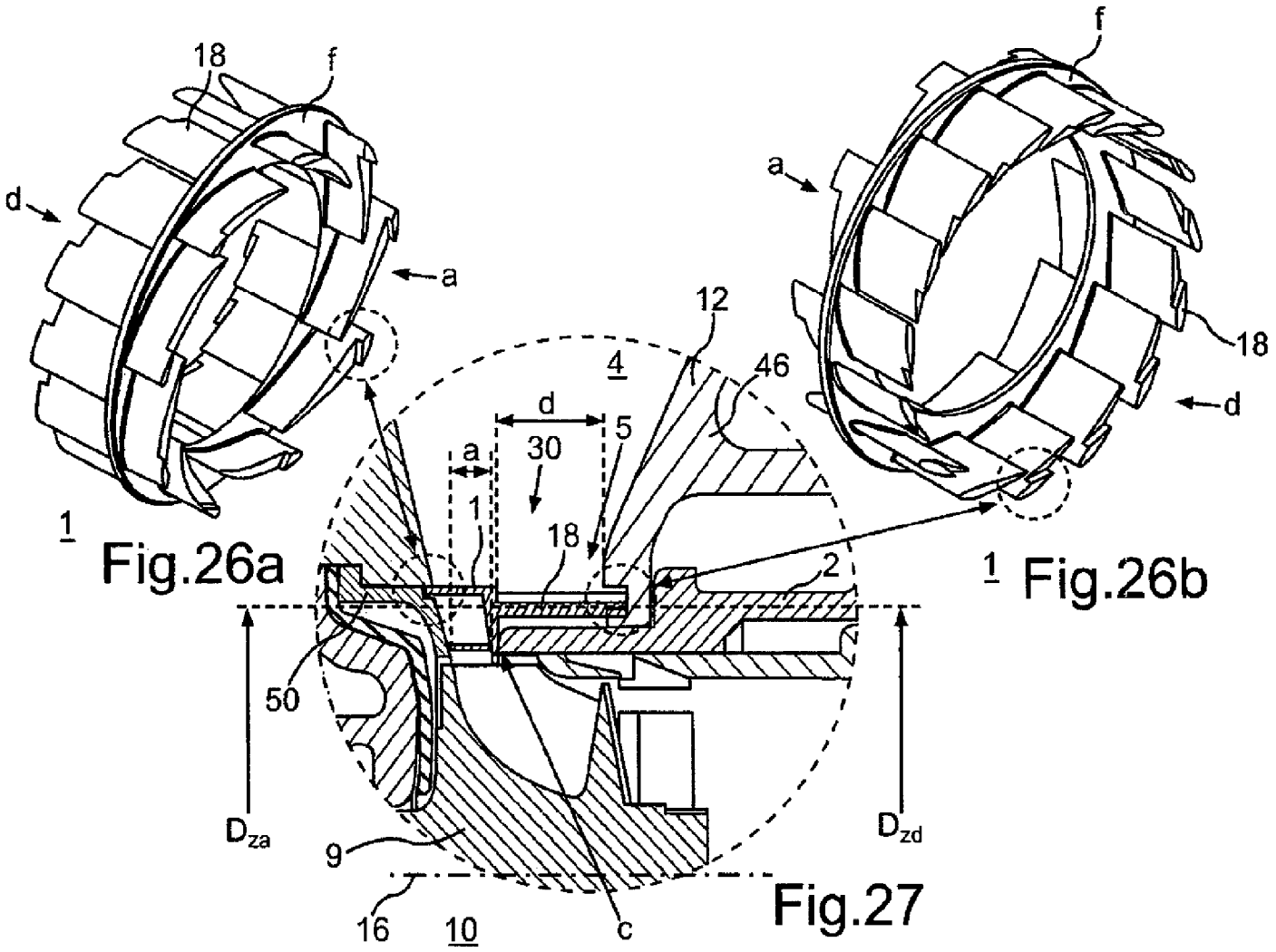
FIG. 26*a* shows a schematic perspective view of another embodiment of the guide vane mechanism according to FIG. 24*a;*
FIG. 26*b* shows a schematic perspective view of the guide vane mechanism according to FIG. 26*a;*
FIG. 27 shows a portion of a schematic longitudinal sectional view of another embodiment of the turbine according to FIG. 7*a* with the guide vane mechanism according to FIGS. 26*a-b;*

FIGS. 26*a*-27 show a possibility for centering the guide vane mechanism 1 in the feed passage 5. For this purpose, a centering insert 50 is provided which has a first centering diameter $D_{Za}$ for centering the first length region a.

On a side opposite the centering insert 50, the turbine casing 12 has a second centering diameter $D_{Zd}$ on which the second length region d is centered.

The guide vanes 18 of the guide vane mechanism 1 comprise corresponding steps, shoulders or the like by means of which the length regions a, d may be centered.

Figures 28A, 28B, 29:
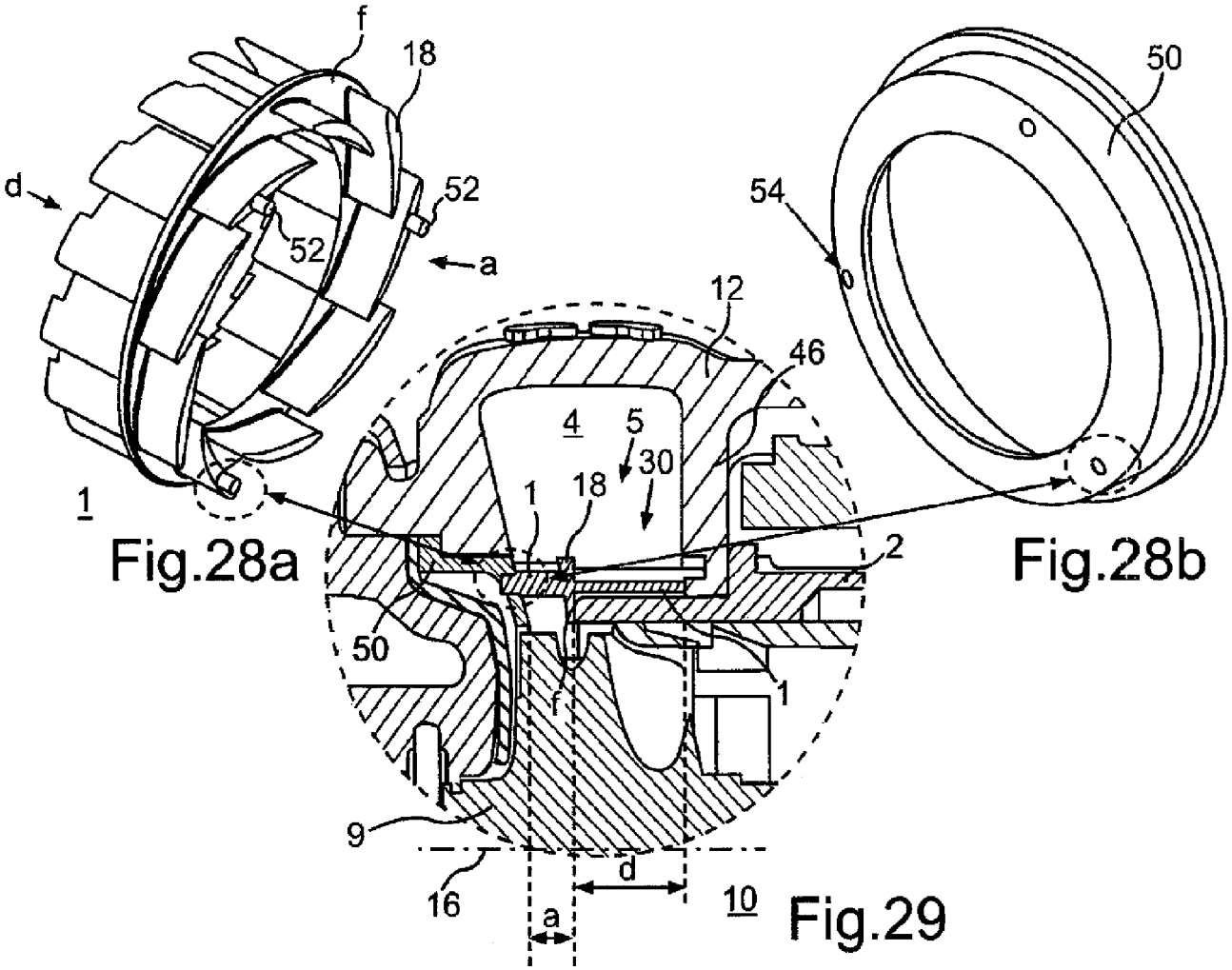
FIG. 28*a* shows a schematic perspective view of another embodiment of the guide vane mechanism according to FIG. 26*a;*
FIG. 28*b* shows a schematic perspective view of a centering element for centering the guide vane mechanism according to FIG. 28.
FIG. 29 shows a portion of a schematic longitudinal sectional view of another embodiment of the turbine according to FIG. 7*a* with the centering element according to FIG. 28*b* and the guide vane mechanism according to FIG. 28*a;*

According to FIGS. 28*a*, 28*b* and 29, the guide vanes 18 comprise centering pins 52 on their end faces which may cooperate with centering holes 54 of the centering insert 50 which is arranged on the bearing housing side.

Figures 30, 31, 32:
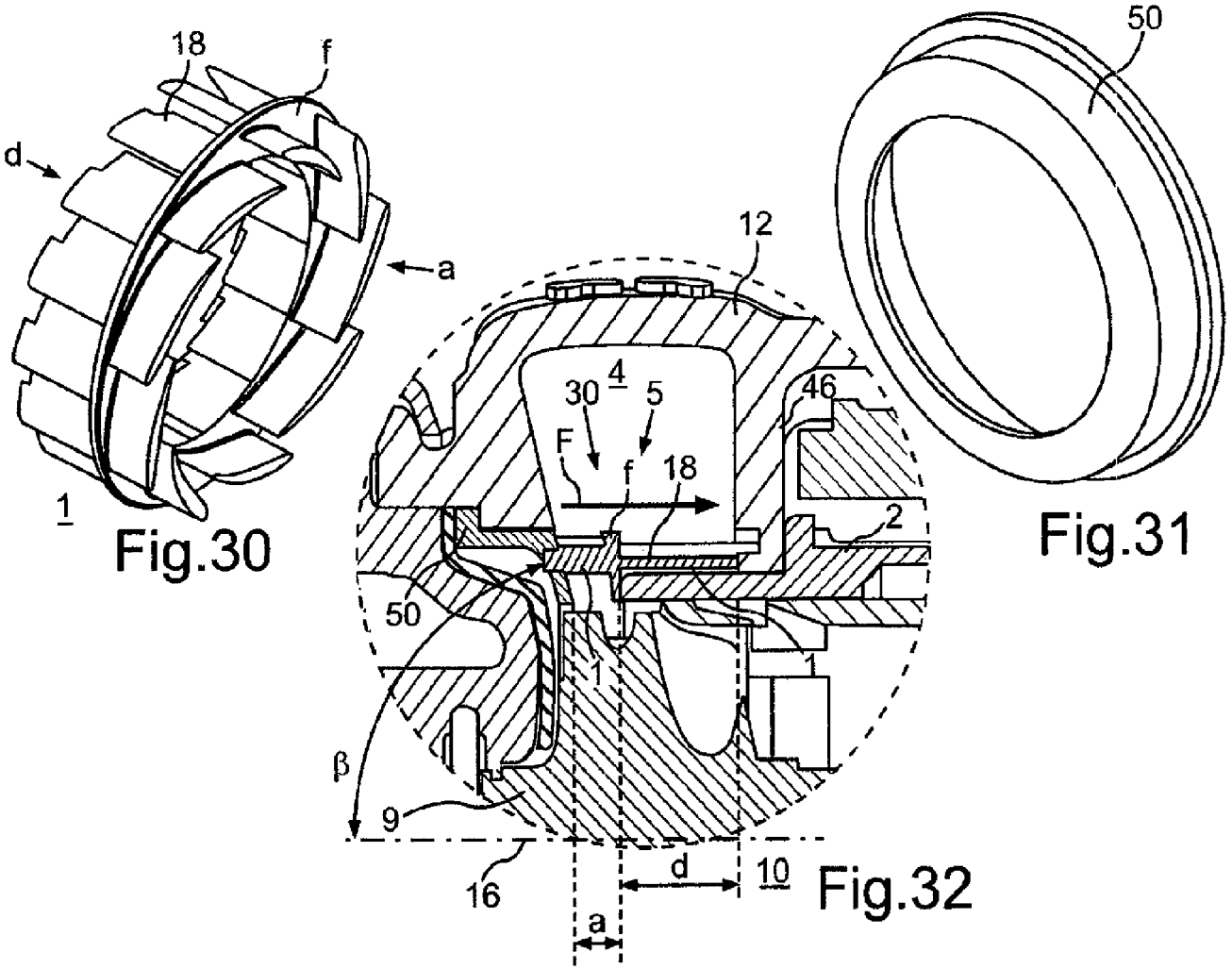
FIG. 30 shows a schematic perspective view of another embodiment of the guide vane mechanism according to FIG. 28*a;*
FIG. 31 shows a schematic perspective view of another embodiment of the centering element according to FIG. 28*b;*
FIG. 32 shows a portion of a schematic longitudinal sectional view of another embodiment of the turbine according to FIG. 7*a* with the guide vane mechanism according to FIG. 30 and the centering element according to FIG. 31.

According to FIGS. 30 to 32, the guide vane mechanism 1 is centered by means of the centering insert 50 in such a manner that respective end faces facing each other of the guide vane mechanism 1, on the one hand, and of the centering insert 50, on the other hand, cooperate. The end faces extend under an angle to the radial direction. As indicated by the centering angle β, the end faces include an angle of at least essentially 75° with the axial direction. A force arrow F indicates the force which is applied to the guide vane mechanism 1 in the feed passage 5 or the direction, of the force application respectively, and which is thereby clamped.

Figure 33:
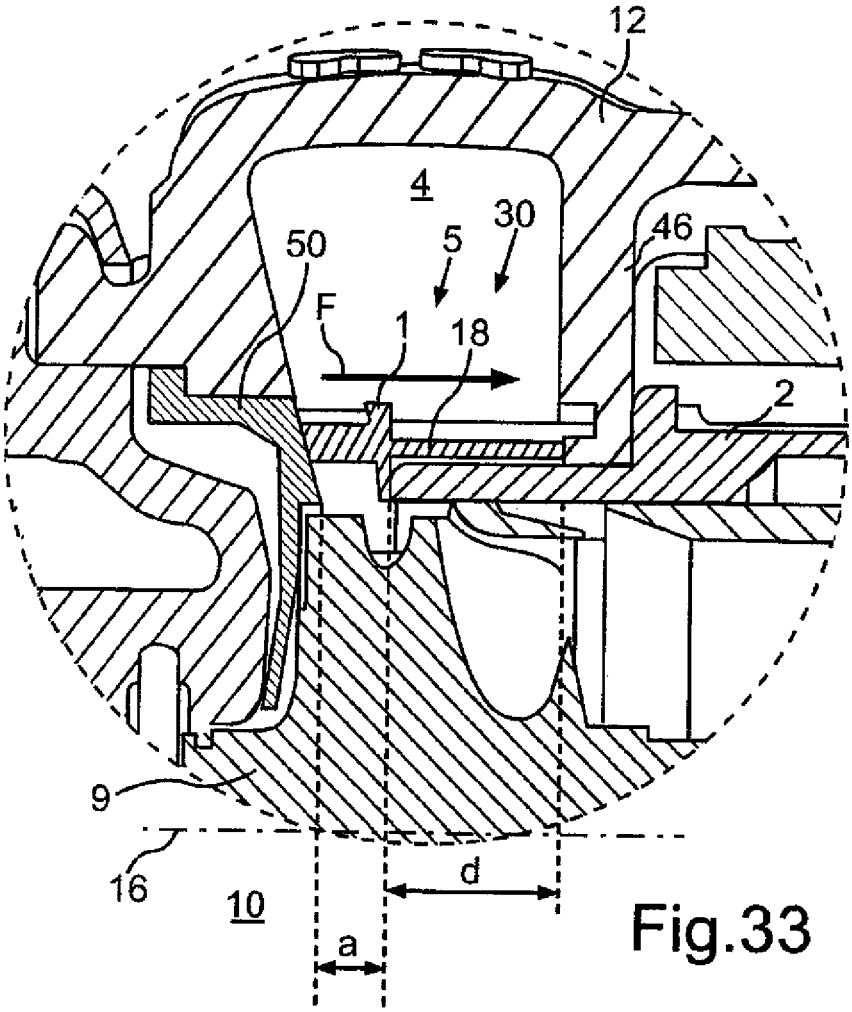
FIG. 33 shows a portion of a schematic longitudinal sectional view of another embodiment of the turbine according to FIG. 32, wherein the centering element is configured as a heat shield.

According to FIG. 33, the centering insert 50 is formed as a heat shield which is to prevent an undesired high heat transfer from the turbine casing 12 into the bearing housing. Thereby, a functional integration is achieved which allows to keep the number of components, the weight and the costs of the turbine 10 low.

What is claimed is:

1. A turbine (10) for an exhaust gas turbocharger with a turbine casing (12) defining a receiving chamber (14) accommodating turbine wheel (9) and at least one volute (4) by which exhaust gas is guided via a feed passage (5) into the receiving chamber (14), the turbine (10) including:

at least one guide vane element (1) arranged in the feed passage (5) fixed relative to the turbine casing (12) so as to project at least in a guide region (30) into the feed passage (5) for guiding the exhaust gas, and comprising a first length region (a) in the guide region (30) relative to the axial direction of the turbine (10), in which the guide vane element (1) has guide vanes (18) designed with a radial airfoil thickness greater than that of a second length region (d) adjoining, and extending axially further from, the first length region (a) in the guide region (30) of the guide vane element (1), with the second length region joining the first length region via a curved transition region (32), and a sliding sleeve element (2) arranged movably in the axial direction along the reduced thickness region of the vanes (18) of the vane element (1) between an open position which maximally opens a flow cross-section of the feed passage (5) in both length regions (a, d) and a closed position which maximally restricts and merely opens the flow cross-section in the first length region (a), the sliding sleeve element (2) having an axial front end which is curved corresponding to the curved transition region (32) of the guide vane element (1) so as to be accommodated thereby in its closed position whereby, upon movement of the sliding element (2) from the closed position effecting swirl generation in the first length (a) to the position any disturbance of the generation of swirling in the first length region (a) is at least mitigated.

2. The turbine (10) according to claim 1, wherein the length regions (a, d) are joined in the axial direction via the transition region (32) which comprises a contour which is at least partially one of circular arc-shaped and elliptical arc-shaped.

3. The turbine (10) according to claim 2, wherein the sliding element (2) comprises an end face (44) which has a second contour corresponding at least essentially to the arc-shaped transition region (32).

4. The turbine (10) according to claim 3, wherein the first contour and the second contour of the sliding element (2) are arranged at least essentially coinciding in the closed position.

5. The turbine (10) according to claim 1, wherein the guide region (30) of the guide vane element (1) extends over the full axial length of the feed passage (5), and a partition wall (46) of the turbine (10), which fluidly separates the volute (4) from a receiving chamber (7) for accommodating an adjusting mechanism of the sliding element (2) has an inner diameter ($D_T$) which is smaller than an inlet diameter ($D_L$) of the guide vane element (1), on which the exhaust gas enters the guide vane element (1).

6. The turbine (10) according to claim (1), wherein a reciprocal value (FB/FA) of the ratio (FA/FB) of a first profile area (FA) of the guide vanes (18) of the guide vane element (1), which extends at least essentially vertically to the axial direction and which is covered in the second length region (d) the closed position by the sliding element (2), to a second profile area (FB) of the guide vane element (1), which extends at least essentially vertically to the axial direction, and which in the closed position of the sliding element (2) is unblocked, is within a range of 10% to 75%.

7. The turbine (10) according to claim 1, wherein at least one dividing element (f) is provided by means of which the length regions (a, d) are fluidly separated from each other.

8. The turbine (10) according to claim 7, wherein the dividing element (1) is engaged in a corresponding groove (48) of the guide vane element (1).

* * * * *